US005761840A

United States Patent [19]

Martin et al.

[11] Patent Number: 5,761,840

[45] Date of Patent: Jun. 9, 1998

[54] LOADER AND TOGGLE LINK ASSEMBLY FOR GUN

[75] Inventors: James M. Martin, Williamson, N.Y.; Casey Cerretani, Tumwater, Wash.

[73] Assignee: Crosman Corporation, East Bloomfield, N.Y.

[21] Appl. No.: 822,677

[22] Filed: Mar. 24, 1997

[51] Int. Cl.[6] ..... F41A 3/00

[52] U.S. Cl. ..... 42/17; 42/6; 42/11

[58] Field of Search ..... 42/17, 6, 11; 124/73, 124/74, 82, 51.1

[56] References Cited

U.S. PATENT DOCUMENTS

| | | | |
|---|---|---|---|
| 977,859 | 12/1910 | Fix | 42/17 |
| 1,073,455 | 9/1913 | Wissler | 124/70 |
| 2,293,957 | 8/1942 | Wells | 124/11 |
| 2,299,073 | 10/1942 | Beasley | 124/11 |
| 2,450,029 | 9/1948 | Wells | 124/13 |
| 2,566,181 | 8/1951 | Fitch | 124/13 |
| 3,421,408 | 1/1969 | Badalt | 89/33 |
| 3,824,981 | 7/1974 | Crane | 124/11 R |
| 4,103,587 | 8/1978 | Vanek | 89/175 |
| 4,164,929 | 8/1979 | Liepins | 124/76 |
| 4,167,890 | 9/1979 | Adams | 89/189 |
| 4,304,213 | 12/1981 | Jereckos | 124/69 |
| 4,422,433 | 12/1983 | Milliman | 124/74 |
| 5,154,157 | 10/1992 | Goepfert | 124/69 |
| 5,165,383 | 11/1992 | Ebert | 124/74 |
| 5,285,766 | 2/1994 | Milliman | 124/72 |
| 5,341,790 | 8/1994 | Ebert | 124/69 |
| 5,363,834 | 11/1994 | Stuchlik | 124/76 |
| 5,476,087 | 12/1995 | Kunimoto | 124/73 |
| 5,477,843 | 12/1995 | Kunimoto | 124/73 |
| 5,565,642 | 10/1996 | Heitz | 89/7 |

*Primary Examiner*—Charles T. Jordan
*Assistant Examiner*—Meena Chelliah

[57] ABSTRACT

A gun is provided with a loader and toggle link assembly for providing repeater action. The gun includes a frame, a barrel on the frame, and a forearm which is pivotally mounted on the frame. The loader is slidably mounted on the frame for movement between firing and loading positions. The toggle link is pivotally mounted on the frame and includes a first end portion which is connected to the loader and a second end portion which is engageable with the forearm. When the forearm closes, the toggle link pivots to move the loader to the firing position. When the forearm opens, a spring pivots the toggle link to move the loader to the loading position.

6 Claims, 5 Drawing Sheets

LOADER AND TOGGLE LINK ASSEMBLY FOR GUN

BACKGROUND AND SUMMARY

This invention relates to a gun with a loader and toggle link assembly for providing repeater action.

Some guns are equipped with bolt action which requires a user to cycle a bolt prior to firing in order to position a projectile for firing. Other guns use a trigger-actuated loader which positions the projectile as the trigger is pulled. Still other guns use a loader mechanism which is activated by a sliding or pivoting forearm or lever.

The invention provides repeater action in a low cost gun without user input. A loader and toggle link assembly cooperates with a pivoting forearm for automatically moving a loader to a loading position when the forearm opens and to a firing position when the forearm closes. A projectile feeding mechanism automatically feeds a projectile to the loader when the loader is in the loading position.

DESCRIPTION OF THE DRAWING

The invention will be explained in conjunction with an illustrative embodiment shown in the accompanying drawing, in which.

DESCRIPTION OF SPECIFIC EMBODIMENT

The invention will be explained in conjunction with an air gun 10. It will be understood, however, that the invention can be used with other types of guns, for example, guns which are powered by compressed $Co_2$.

The gun includes a frame or receiver 11 which includes right and left halves 11*a* and 11*b* which are bolted together. A stock 12 is secured to the receiver.

Figure 4:
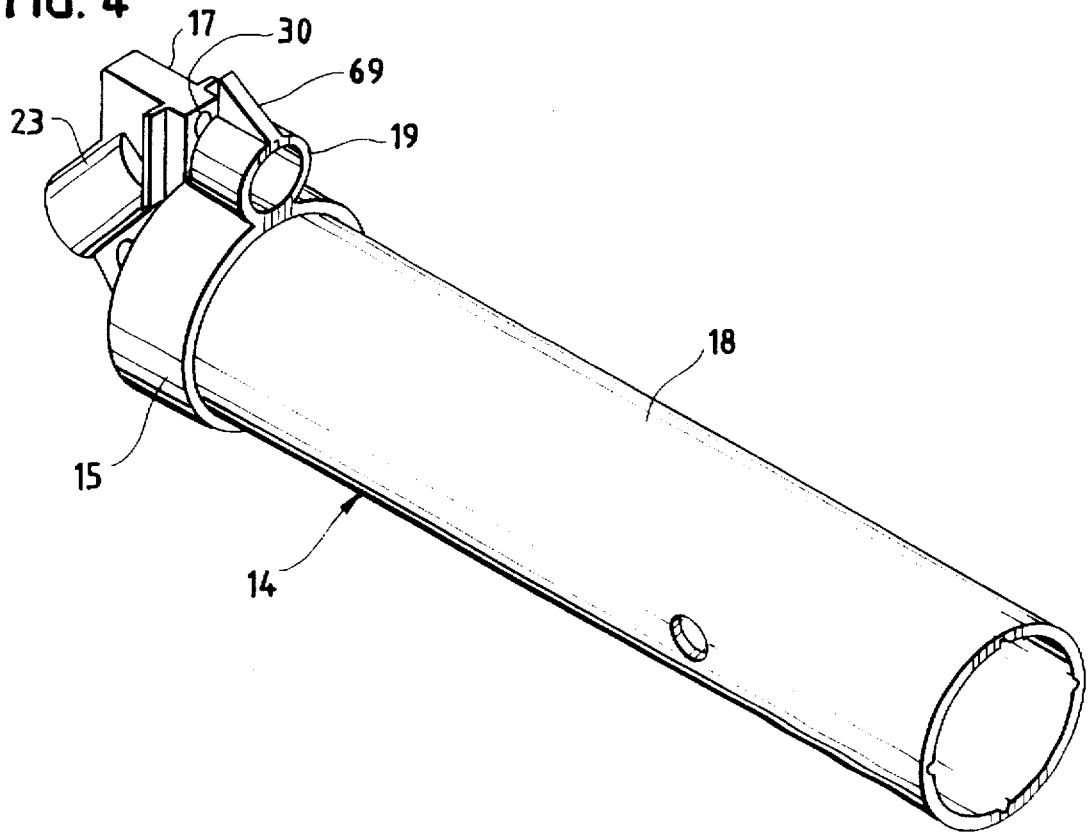
FIG. 4 is a perspective view of the valve body.

A valve assembly 14 (see also FIGS. 4 and 5) includes a single piece valve body 15 and a valve stem 16. The valve body 15 is molded integrally from plastic, preferably Delrin, and includes a substantially solid rear portion 17, a tubular front portion 18 (FIG. 4), and a socket-shaped barrel mounting portion 19. The barrel mounting portion has a barrel opening 20 (FIG. 5) and a breech opening 21. A loader slot 22 is provided in the valve body behind the breech opening. A tubular portion 23 angles downwardly and rearwardly from the loader slot.

An elongated barrel 24 includes a rear or breech end which is inserted into the opening 20 in the barrel mounting portion. A gasket or O-ring can be mounted in the valve body to provide a seal around the barrel.

The tubular portion 18 of the valve body provides a compression tube, and a piston 26 is reciprocably mounted in the bore of the tube. A gasket 27 is positioned in an annular groove in the piston and provides a seal between the piston and the tube.

An air passage 29 (FIG. 5) in the valve body extends between the bore of tubular potion and the loader slot 22. The air passage includes a first rearwardly extending portion 29*a*, an enlarged cylindrical portion 29*b* in the angled tubular portion 23 of the valve body, and a reduced diameter angled portion 29*c*. The portion 29*c* has an exit port 30 which is aligned with the breech opening 21.

The elongated cylindrical valve stem 16 is slidably mounted in the cylindrical portion 29*b* of the air passage and includes an outer end 32 which extends downwardly from the valve body. A gasket or O-ring 33 is mounted on the inner end of the valve stem and seals against the valve body. When the valve stem is in the closed position illustrated in FIG. 5, the gasket is positioned at the intersection of the air passages 29*a* and 29*b* and blocks the air passage 29.

Figure 1:
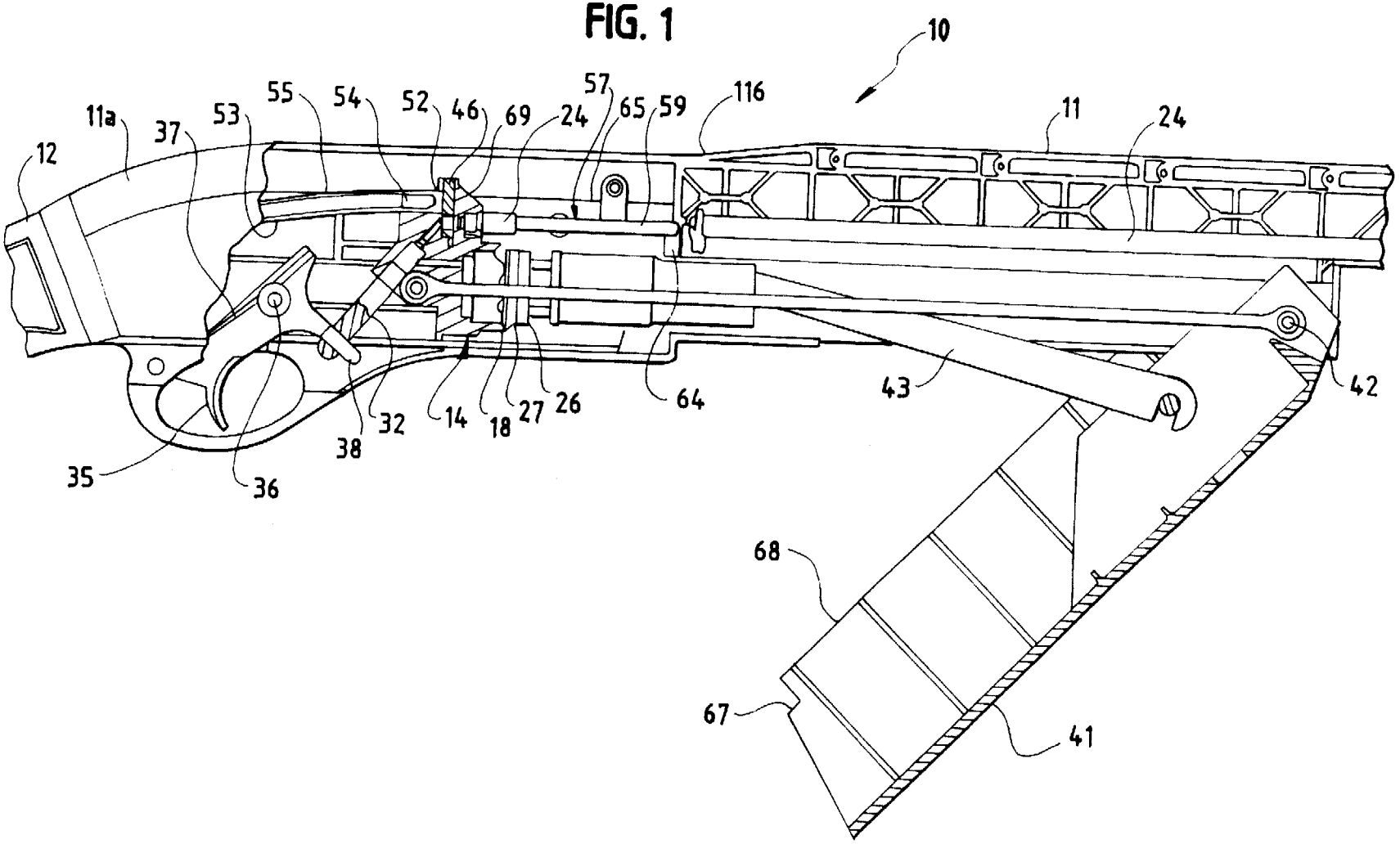
FIG. 1 is a fragmentary sectional view of a gun which includes the inventive loader and toggle link assembly.
Figure 5:
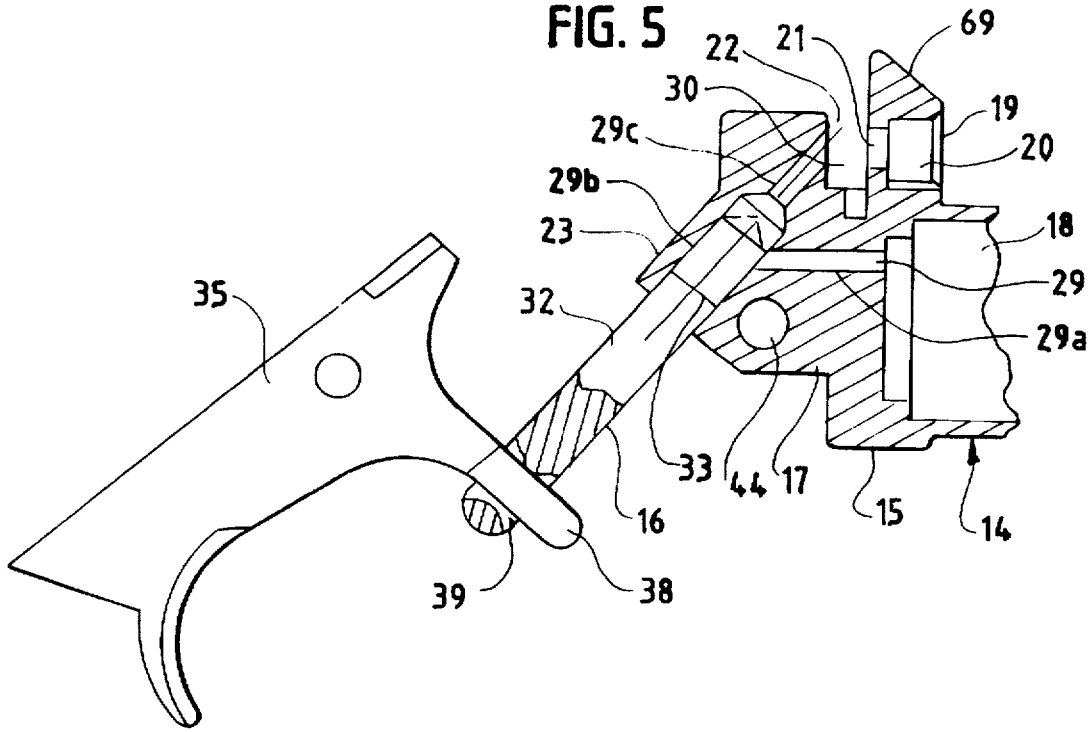
FIG. 5 is an enlarged fragmentary sectional view of the valve assembly and trigger.

A trigger 35 is pivotally mounted in the receiver by a pin 36 (FIG. 1). A trigger spring 37 biases the trigger to a forward portion which is illustrated in FIGS. 1 and 5. The trigger includes a finger 38 or crank arm (FIG. 5) which extends through an opening 39 in the outer end of the valve stem 16. When the trigger is pulled, the finger 38 pulls the valve stem 32 downwardly so that the gasket 33 unblocks the air passage 29*a* and opens the air passage 29.

The piston is reciprocated by a forearm 41 (FIG. 1) which is pivotally secured to the receiver by a pivot pin 42. A link 43 connects the forearm to the piston. The forearm is shown in its open position in FIG. 1, and the link 43 has retracted the piston away from the air passage 29.

When the forearm is pivoted clockwise to the closed position in which the forearm extends parallel to and alongside the receiver, the piston is forced rearwardly toward the air passage 29 and compresses the air between the piston and the valve stem 16.

The tubular portion 18 of the valve body is molded with a no draft portion which is approximately 3.123 inches long to provide better sealing with the piston and better efficiency. The valve assembly is substantially unaffected by small changes in pump stroke length, i.e., the projectile velocity remains consistent despite variation in the assembly.

The valve body requires no assembly other than placement in the receiver. The valve body is held in the receiver by a single post which extends through an opening 44 (FIG. 5) in the valve body. A pair of ribs on the receiver maintain the position of the valve body.

The Delrin material of the valve body provides a better wear surface against the gasket 27 on the piston 26 and reduces the possibility of cutting the gasket. The use of plastic rather than metal also reduces cost.

Figure 2:
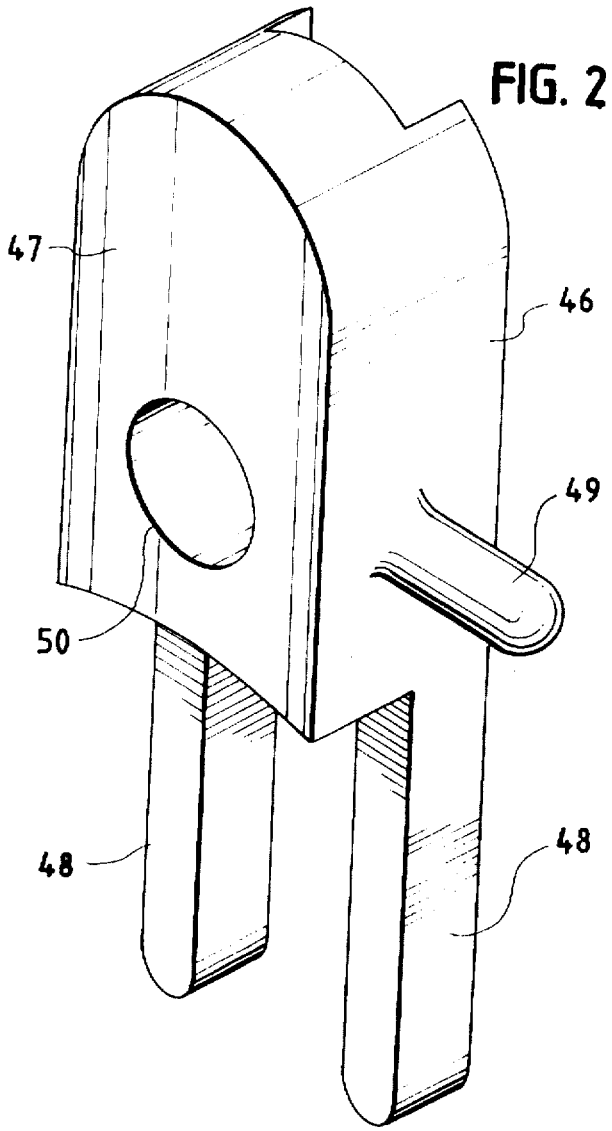
FIG. 2 is an enlarged perspective view of the loader.

A loader 46 (FIGS. 1 and 2) straddles the valve body and is slidably mounted in the slot 22. Referring to FIG. 2, the loader includes a main body 47, a pair of downwardly extending parallel legs 48, and a laterally extending pin 49. A projectile opening 50 extends through the main body. A magnet may be mounted in the loader adjacent the opening for maintaining a projectile in the opening until the gun is fired.

Figure 6:
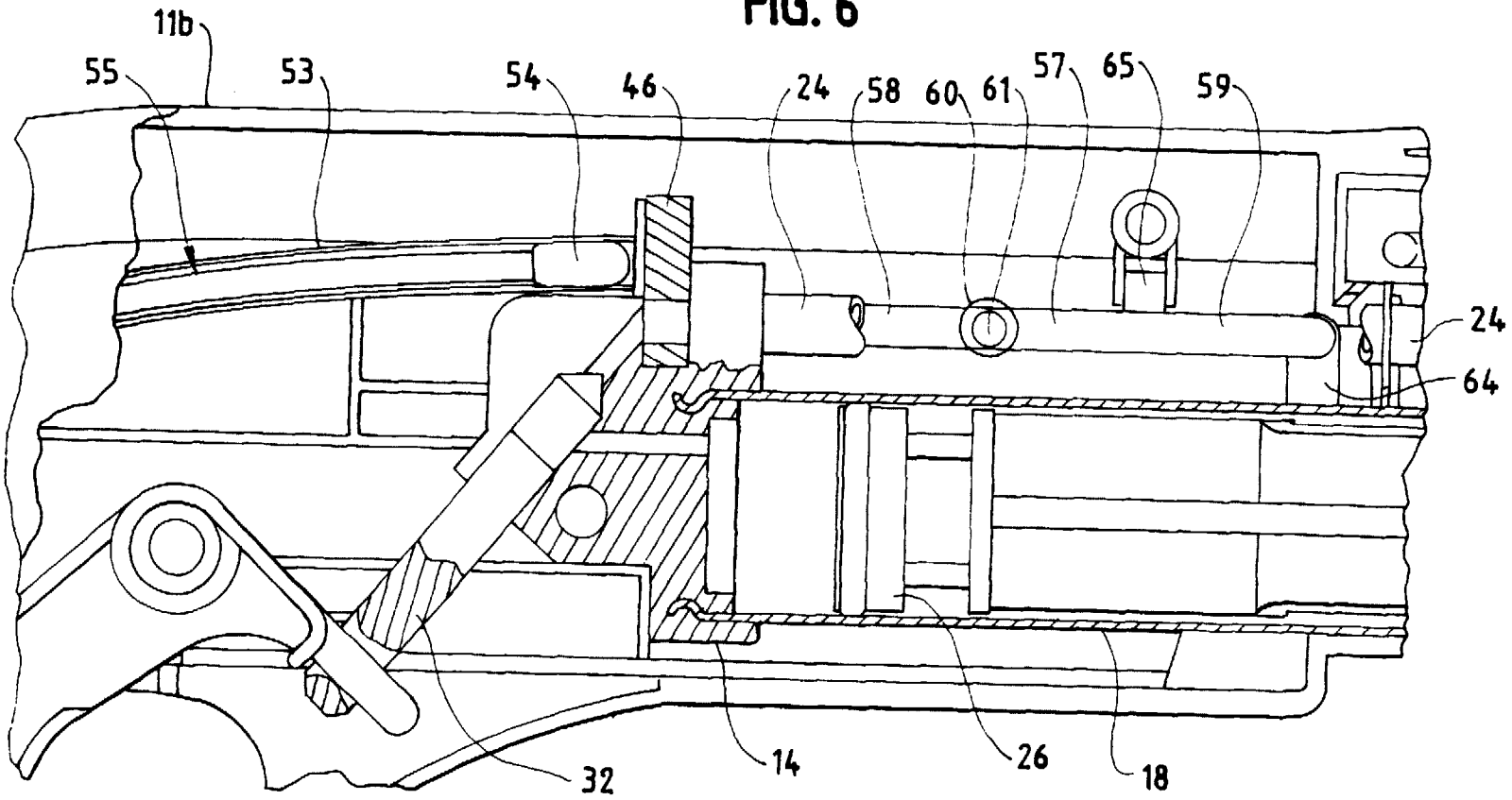
FIG. 6 is an enlarged fragmentary sectional view of the valve assembly, loader, and toggle link.

The legs 48 straddle the valve body, and the loader is movable between a firing position illustrated in FIGS. 1 and 6 and a loading position. In the firing position the projectile opening 50 is aligned with the openings 21 and 30 (FIG. 5) in the valve body. In the loading position the loader is raised so that the projectile opening 50 is aligned with an exit port 52 (FIG. 1) of a projectile magazine 53. The magazine is provided by ribs on the receiver halves which provide an internal chamber for storing projectiles for example, BB's. A BB pusher 54 is slidably mounted in the magazine for pushing BB's toward the exit port 52. A spring 55 engages the pusher and resiliently biases the pusher toward the exist port.

Figure 3:
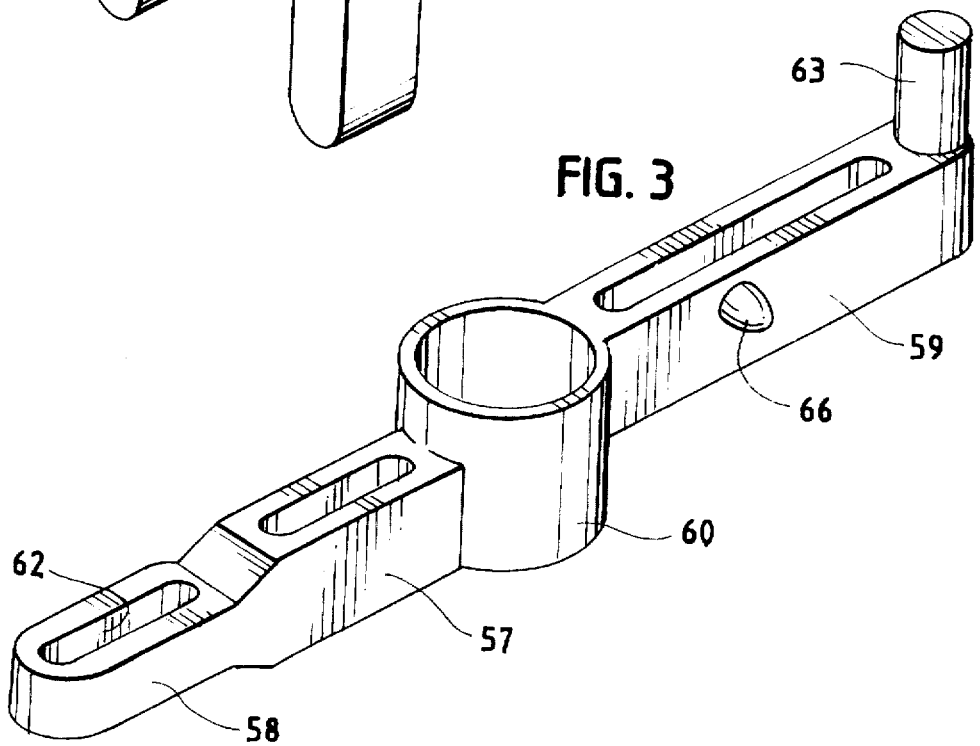
FIG. 3 is an enlarged perspective view of one part of the toggle link.
Figure 7:
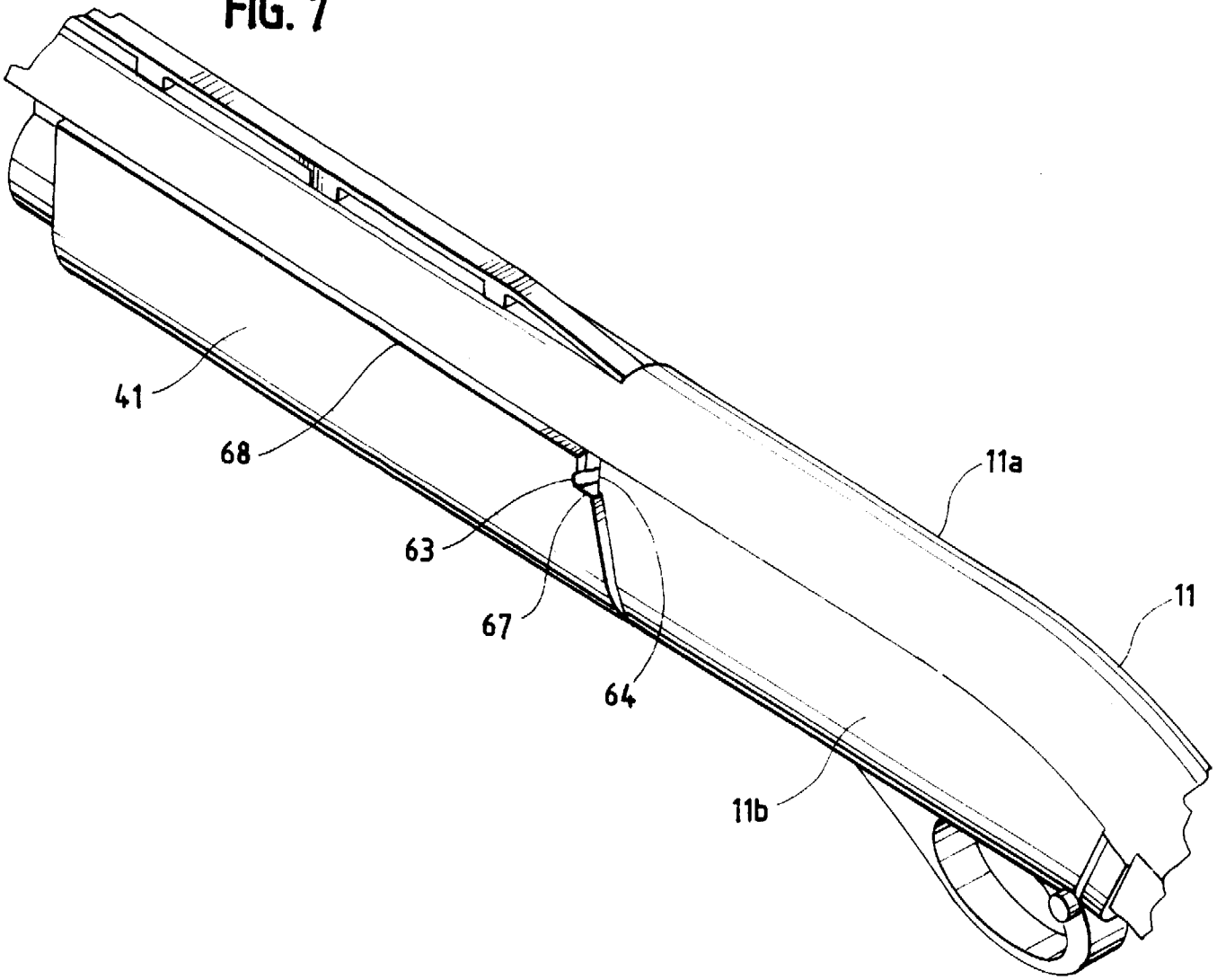
FIG. 7 is a perspective view of the gun showing the forearm closed.

A elongated toggle link 57 is pivotally mounted on the receiver for moving the loader between the loading and firing positions. Referring to FIG. 3, the toggle link includes a first or rear end portion 58, a second or forward end portion 59, and an intermediate portion 60. The intermediate portion comprises a cylindrical bushing which is pivotally mounted on a pin or boss 61 (FIG. 6) on the receiver. The rear end portion 58 is provided with a slot 62 into which the pin 49 on the loader extends. The forward end portion 59 includes a laterally outwardly extending pin 63 which extends through an elongated slot 64 (FIGS. 6 and 7) in the left receiver half 11*b*.

The toggle link is resiliently biased to rotate clockwise in FIG. 6 by a spring 65 which engages the forward end 59 of the toggle link. The spring is ensleeved over a positioning pin 66 (FIG. 3) on the toggle link.

FIG. 6 illustrates the position of the toggle link when the forearm 41 is closed. A notch 67 (FIG. 7) in the upper left edge 68 of the forearm engages the pin 63 of the toggle link and maintains the pin adjacent the upper end of the slot 64 in the receiver. The toggle link extends generally parallel to the barrel 24 (FIG. 6) and maintains the loader 46 in the firing position.

When the forearm is open, the spring 65 rotates the toggle link 57 clockwise, and the pin 63 moves downwardly in the slot 61. The rear end of the toggle link moves upwardly and raises the loader pin 49 and the loader to the loading position. The BB pusher 54 pushes a BB or other projectile into the opening 50 in the loader. An upwardly extending rib 69 (FIGS. 4 and 5) on the barrel mounting portion 19 of the valve body is aligned with the opening 50 and prevents the BB from being pushed out of the loader.

Closing the forearm not only compresses air in the tubular position of the valve body but also moves the loader to the firing position. As the forearm pivots upwardly, the forearm engages the outwardly extending pin 63 of the toggle link and pushes the pin upwardly. The forward end of the toggle link is thereby rotated upwardly, and the rear end of the toggle link is rotated downwardly. Downward movement of the rear end moves the loader to the firing position where the projectile in the loader is aligned with the barrel 24.

When the forearm is closed, the gun is fired by pulling the trigger 35. The finger 38 rotates clockwise and pulls the valve stem 16 downwardly so that the gasket 33 opens the air passage 29. Compressed air flows through the air passage and propels the projectile out of the loader 46 and through the barrel 24.

The automatic loading and firing process can be repeated simply by opening and closing the forearm 41. Opening the forearm raises the loader 46 to the loading position where the BB pusher 54 will push a BB into the opening 50 of the loader. Closing the forearm compresses air in the compression tube 18 of the valve body and lowers the loader to the firing position.

The gun does not require detailed user instruction, as is common with bolt action guns, since no additional action other than opening and closing the forearm is required to load the gun.

While in the foregoing specification a detailed description of specific embodiments of the invention were set forth for the purpose of illustration, it will be understood that many of the details herein given can be varied considerably by those skilled in the art without departing from the spirit and scope of the invention.

We claim:

1. A loader and toggle link assembly for a gun having a frame, a barrel mounted on the frame, and a forearm pivotally mounted on the frame, for movement between a closed position and an open position, the loader and toggle link assembly comprising:

a loader slidably mounted in the frame adjacent the barrel, the loader having a projectile-receiving opening and being movable between a firing position in which the opening is aligned with the barrel and a loading position in which the opening is not aligned with the barrel, a toggle link having first and second end portions and an intermediate portion, the intermediate portion being pivotally mounted on the frame so that the first end portion is pivotable between first and second positions, the first end portion being connected to the loader so that pivoting movement of the first end portion between the first and second positions moves the loader between the firing and loading positions, means for resiliently biasing the first end portion of the toggle link to the second position, means on the second end portion of the toggle link for engaging the forearm when the forearm is in the closed position and for moving the first end portion to the first position so that the loader is in the firing position, whereby when the forearm is moved to the open position the biasing means moves the first end portion of the toggle link to the second position so that the loader is moved to the loading position.

2. The loader and toggle link assembly of claim 1 in which the means for engaging the forearm comprises a pin which extends generally perpendicularly to the second end portion of the toggle link.

3. The loader and toggle assembly of claim 2 in which the pin extends through a slot in the frame.

4. The loader and toggle link assembly of claim 1 in which the gun includes a projectile chamber having an outlet opening which is aligned with the projectile-receiving opening in the loader when the loader is in the loading position.

5. The loader and toggle link assembly of claim 4 in which the gun includes means for urging projectiles in the projectile chamber toward the outlet opening.

6. The loader and toggle link assembly of claim 1 in which the first end portion of the toggle link is provided with a slot which extends generally perpendicularly to the pivot axis of the toggle link and the loader includes a projection which extends into the slot.

* * * * *